US008585511B2

(12) United States Patent
Sato et al.

(10) Patent No.: US 8,585,511 B2
(45) Date of Patent: Nov. 19, 2013

(54) GOLF CLUB HEAD AND GOLF CLUB

(75) Inventors: Fumiaki Sato, Chichibu (JP); Kozue Wada, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 1239 days.

(21) Appl. No.: 12/944,366

(22) Filed: Nov. 11, 2010

(65) Prior Publication Data

US 2011/0118045 A1 May 19, 2011

(30) Foreign Application Priority Data

Nov. 13, 2009 (JP) ..... 2009-259921

(51) Int. Cl.
*A63B 53/02* (2006.01)

(52) U.S. Cl.
USPC ..... 473/307; 473/288; 473/246

(58) Field of Classification Search
USPC ..... 473/288, 307, 244–248
See application file for complete search history.

(56) References Cited

U.S. PATENT DOCUMENTS

| | | | | |
|---|---|---|---|---|
| 1,540,559 | A | 6/1925 | Murphy | |
| 2,067,556 | A | 1/1937 | Wettlaufer | |
| 2,085,002 | A * | 6/1937 | Buzzard | 205/139 |
| 2,219,670 | A | 10/1940 | Wettlaufer | |
| 7,083,529 | B2 | 8/2006 | Cackett et al. | |
| 7,326,126 | B2 | 2/2008 | Holt et al. | |
| 7,335,113 | B2 | 2/2008 | Hocknell et al. | |
| 7,344,449 | B2 | 3/2008 | Hocknell et al. | |
| 7,476,160 | B2 | 1/2009 | Hocknell et al. | |
| 7,530,900 | B2 | 5/2009 | Holt et al. | |
| 7,704,156 | B2 * | 4/2010 | Stites et al. | 473/246 |
| 7,794,331 | B2 * | 9/2010 | Tsai et al. | 473/288 |
| 7,819,754 | B2 * | 10/2010 | Evans et al. | 473/307 |
| 8,025,587 | B2 * | 9/2011 | Beach et al. | 473/245 |
| 8,029,383 | B2 * | 10/2011 | Yamamoto | 473/307 |
| 2008/0280693 | A1 * | 11/2008 | Chai | 473/288 |
| 2009/0062029 | A1 * | 3/2009 | Stites et al. | 473/288 |

FOREIGN PATENT DOCUMENTS

| | | | |
|---|---|---|---|
| JP | 9084903 | A | 3/1997 |
| JP | 9117535 | A | 5/1997 |
| JP | 2000005349 | A | 1/2000 |
| JP | 2003-225333 | A | 8/2003 |
| JP | 2005-270402 | A | 10/2005 |

(Continued)

OTHER PUBLICATIONS

Office Action dated Jul. 9, 2013 issued by the Japanese Patent Office in counterpart Japanese Patent Application No. 2009-259921.

*Primary Examiner* — Stephen L. Blau
(74) *Attorney, Agent, or Firm* — Sughrue Mion, PLLC

(57) ABSTRACT

A golf club head includes: a head main body formed with a hosel column inserting hole; a hosel column which is formed with a shaft inserting hole and is installed on the hosel column inserting hole; a bolt inserting hole penetrating from a sole side of the head main body to the hosel column inserting hole; and a bolt which is inserted into the bolt inserting hole and is screwed into the hosel column, wherein: the hosel column includes a trunk portion provided with a shaft inserting hole, and a leg portion which protrudes from a lower end surface of the trunk portion and is inserted into the hosel column inserting hole; and at least a lower end side of the leg portion and an inner portion of the hosel column inserting hole are polygonal sectional shape portions and are engaged with each other.

13 Claims, 12 Drawing Sheets

(56) References Cited

FOREIGN PATENT DOCUMENTS

| | | | |
|---|---|---|---|
| JP | 2006042951 | A * | 2/2006 |
| JP | 2008520274 | A | 6/2008 |
| JP | 2008-259862 | A | 10/2008 |
| JP | 2009-545393 | A | 12/2009 |
| WO | 2008016784 | A2 | 2/2008 |

* cited by examiner

GOLF CLUB HEAD AND GOLF CLUB

BACKGROUND

1. Field of the Invention

The present invention relates to a golf club and a head thereof. Particularly, the present invention relates to a golf club and a head thereof capable of easily performing control of properties such as a lie angle, a slice angle and a goose neck shape.

2. Description of the Related Art

A golf club has a head attached to a front end portion of a shaft. A grip is installed in a proximal end side of the shaft.

In a general golf club head of the related art, a hosel port is directly provided on a hosel portion of the head, and a shaft is inserted into the hosel port and is fixed by an adhesive. In addition, as the adhesive, an epoxy-based adhesive is generally used. When the shaft is exchanged, the shaft is pulled out by heating the hosel portion to destroy a structure formed of an epoxy resin hardening product.

In JP-A-2000-5349, there is described a golf club in which a hosel joint is bonded to a front end of the shaft, the hosel joint is inserted into the hosel hole of the golf club head, and the hosel joint is fixed to the golf club head by a bolt inserted from a sole side. JP-A-2000-5349 shows a golf club head in which a loft angle and a lie angle can be adjusted by slightly tilting the shaft with respect to the hosel joint.

In the golf club head of JP-A-2000-5349, a cross section, which is perpendicular to an axis center of the hosel joint and the hosel hole, has a circular shape. For that reason, a direction (hereinafter called "phase") of the hosel joint in a circumferential direction can be arbitrarily controlled. However, when the phase has changed, an original phase becomes unknown, whereby, even if it is thought that a control of a direction of the original phase is satisfactory, it is difficult to accurately return to (reproduce) the original phase. Furthermore, since the golf club head has a configuration in which the overall hosel joint is fitted into the hosel, the diameter of the hosel increases, which makes the weight of the head on the heel side become excessive.

SUMMARY

An object of the present invention is to solve the above-mentioned problem and provide a golf club and a head that can perform a phase positioning of a hosel column and can control properties such as a lie angle, a slice angle and a goose neck shape with good reproducibility. Furthermore, another object of the present invention is to provide a head in which an excessive increase in weight of the heel side is prevented in one aspect thereof.

According to an aspect of the invention, there is provided a golf club head including: a head main body formed with a hosel column inserting hole which is recessed from an upper end surface of the hosel portion; a hosel column which is formed with a shaft inserting hole and is attachably and detachably installed on the hosel column inserting hole; a bolt inserting hole penetrating from a sole side of the head main body to the hosel column inserting hole; and a bolt which is inserted into the bolt inserting hole and is screwed into the hosel column to fix the hosel column to the head main body, wherein: the hosel column includes a trunk portion provided with a shaft inserting hole, and a leg portion which protrudes from a lower end surface of the trunk portion and is inserted into the hosel column inserting hole; and at least a lower end side of the leg portion and an inner portion of the hosel column inserting hole are polygonal sectional shape portions and are engaged with each other.

An axis center of the shaft inserting hole and an axis center of the hosel column inserting hole may have non-coaxial shapes.

The axis center of the shaft inserting hole may incline with respect to the axis center of the hosel column inserting hole.

The axis center of the shaft inserting hole may be parallel to the axis center of the hosel column inserting hole, and the axis center of the shaft inserting hole may be separated from the axis center of the hosel column inserting hole by a predetermined distance.

A diameter of the leg portion may be smaller than that of the trunk portion, an inner peripheral surface of an upper portion of the hosel column inserting hole and an outer peripheral surface of an upper portion of the hosel column may be cylindrical portions, respectively, and lower sides of the cylindrical portions may be regular polygonal pyramid portions that shrink toward a lower part.

The golf club head may further include an elastic body interposed between the regular polygonal pyramid portion of the hosel column and the regular polygonal pyramid portion of the hosel column inserting hole.

The lower end surface of the trunk portion may be in contact with the upper end surface of the hosel portion directly or via a packing.

The golf club head may further include: convex portions protruding from one side of the upper end surface of the hosel portion and the lower end surface of the trunk portion toward the other side thereof; and concave portions engaged with the convex portions are formed on the other side, wherein the convex portions and the concave portions is respectively provided with gaps in a circumferential direction of the hosel column inserting hole.

The convex portions and the concave portions may be respectively provided in the same number as the number of angles of polygonal section shape portions of a lower end side of the leg portion and an inner portion of the hosel column inserting hole.

An outer peripheral surface of the hosel portion may be continuously formed with an outer peripheral surface of the trunk portion.

The golf club head may be an iron type golf club head.

According to another aspect of the invention, there is provided a golf club including: a shaft; and a golf club head including: a head main body formed with a hosel column inserting hole which is recessed from an upper end surface of the hosel portion; a hosel column which is formed with a shaft inserting hole and is attachably and detachably installed on the hosel column inserting hole; a bolt inserting hole penetrating from a sole side of the head main body to the hosel column inserting hole; and a bolt which is inserted into the bolt inserting hole and is screwed into the hosel column to fix the hosel column to the head main body, wherein: the hosel column includes a trunk portion provided with a shaft inserting hole, and a leg portion which protrudes from a lower end surface of the trunk portion and is inserted into the hosel column inserting hole; at least a lower end side of the leg portion and an inner portion of the hosel column inserting hole are polygonal sectional shape portions and are engaged with each other; and a front end of the shaft is inserted and fixed to the shaft inserting hole of the golf club head.

In the golf club and the head thereof of the present invention, a leg portion of a hosel column is inserted into a hosel column inserting hole of a hosel portion of a head main body, the hosel column is attachably and detachably installed by a bolt, and a shaft is fixed to a shaft inserting hole of the hosel column. Since a lower end side of the hosel column and an inner portion of the hosel column inserting hole have a polygonal section shape in the present invention, a positioning (a phase decision) of the hosel in a circumferential direction is performed with good reproducibility. Furthermore, a rotation between the head and the hosel column is prevented.

In the above aspect, since an axis center of the shaft inserting hole is not coaxial with an axis center of the hosel column inserting hole, by changing the phase of the hosel column, the lie angle, the slice angle or the goose neck shape can be controlled.

For example, in the case of a hosel column in which the axis center of the shaft inserting hole is in a slope direction (e.g., a slope intersecting direction) with respect to the axis center of the hosel column inserting hole, the lie angle or the slice angle is changed by changing the phase of the hosel column.

Thus, in a golf club including the same shafts and the same head main bodies, it is possible to control only the lie angle or the slice angle.

In addition, in the case of a hosel column in which the position of the axis center of the hosel column inserting hole deviates from the position of the axis center of the hosel column inserting hole in the shape of a parallel movement, by changing the phase of the hosel column, in the golf club including the same shafts and the same head main bodies, it is possible to control the goose neck shape or a distance (a distance of the center) from the shaft to the center.

Furthermore, in the present invention, it is also possible to exchange the shaft with the hosel column to exchange the shaft. That is, hosel columns are prepared having exactly the same shape, a special shaft is fixed to the hosel column to make a connection body of the hosel column and the shaft, and the connection body of hosel column and the shaft is exchanged with the present connection body of hosel column and the shaft to attach the same to the hosel column inserting hole of the head, whereby it is possible to obtain a golf club in which only the shaft differs.

According to the shaft exchanging method, the structure of the adhesive is destroyed by heating to detach the shaft, so that it is possible to eliminate a cumbersome task and time in which a new shaft is attached with an adhesive again. For that reason, the connection body of hosel column and the shaft is detached from the head of the golf club which has been used for a trial shot, and a separate connection body of the hosel column and the shaft with different property can be attached to the head to perform a trial shot without delay. Thus, it is extremely easy for a golfer to find a suitable golf club in a golf shop or the like. In addition, it is possible to evaluate the shaft without considering individual difference.

Recently, in order that a golfer finds a golf club which is suited to his own ability, a system is developed which finds a golf club matched by the use of a computer, a high speed camera or the like. This system is a system which searches the individual available clubs by comparing a strike to the base on the basis of a head speed, a striking angle or the like.

On the contrary, according to the golf club of the present invention, only a positional relationship of the same shaft and the head can be changed to change the center distance or a progression and a difference in ball flight property (a striking angle or a spin) of the struck ball can easily be felt, or only the shaft can be exchanged with respect to the same head to feel the difference only in shaft. Furthermore, the shaft can be exchanged depending on a condition of a player, or in order to adjust the lie angle or the slice angle and the amount of face progression while the shaft is identical, it is possible to change the attachment direction of the shaft relative to the head.

In the present invention, by inserting only the leg portion of the hosel column to the hosel column inserting hole and making the diameter of the leg portion small, the diameter of the hosel portion is not excessive.

When an elastic body is interposed between the lower end of the hosel column and the inner portion surface of the hosel column inserting hole, an impact or a vibration between the hosel column inserting hole and the hosel column is absorbed.

Convex portions protrude from one side of the upper end surface of the hosel portion and a lower surface of a trunk portion toward the other side, and the convex portions are engaged with concave portions provided on the other side, whereby a rotation prevention effect of the shaft in a direction around the axis center of the shaft, that is, a fixing rigidity of the hosel column in a torque direction, is improved.

In this case, it is desirable that the convex portions and the concave portions be provided in the same numbers as the numbers of the angles of the polygonal section shape portions of the lower end side of the hosel column leg portion and the inner portion of the hosel column inserting hole, with gaps in the circumferential direction of the hosel column inserting hole. In this case, as configured above, by matching the phase of the hosel column so that each convex portion of one side of the hosel side and the hosel column side confronts each concave portion of the other side to insert the hosel column leg portion into the hosel column inserting hole, the polygonal section shape portions of the lower end side of the hosel column leg portion and the inner portion of the hosel column inserting hole are automatically engaged with each other. As a result, when the lower end side of the hosel column leg portion is inserted into the hosel column inserting hole, even if it is difficult to confirm the polygonal section shape portions, the phase matching of the hosel column can easily be performed while seeing the concave portions and the convex portions.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Hereinafter, a first embodiment will be described with reference to FIGS. 1 to 7.

In this embodiment, a head 1 is an iron type golf club head. The head 1 has a head main body 2, and a hosel column 5 which is attachably and detachably attached to the head main body 2. A plurality of score lines 2*a* is provided on a face surface of the head main body 2 in a horizontal direction. A hosel column inserting hole 2H is recessed from the upper end surface of a hosel portion 2*b*. The hosel column inserting hole 2H has a cylindrical shape with an open upper end and a closed lower end and extends in a inserting direction of the shaft 4. An inner peripheral surface of hosel column inserting hole 2H is a cylindrical portion except for a lower part thereof. An outer peripheral edge of the upper end surface of the hosel portion 2*b* has a circular shape which is coaxial with the hosel column inserting hole 2H.

An inner peripheral surface on an inner side further than the cylindrical portion of the hosel column inserting hole 2H has a regular polygonal pyramid shape, which is reduced in diameter as it goes to the inner side, and has a plurality of slope surfaces 2*k* (see FIG. 2) intersecting the axis center of the hosel column 5 provided therein. It is preferable that an intersecting angle (an included angle) of a pair of opposed slope surfaces 2*k* be about 10 to 30°, in particular, about 15 to 20°.

Figure 2:
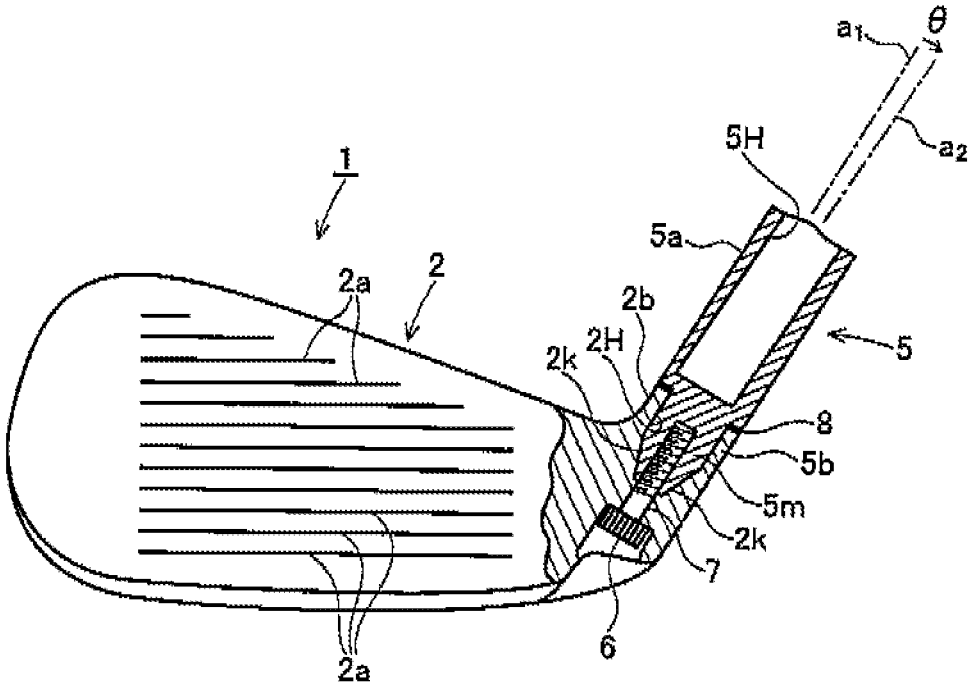
FIG. 2 is a front view of the head of FIG. 1 with a hosel portion shown in a longitudinal sectional view.

A leg portion 5*b* of the hosel column 5 is inserted into the hosel column inserting hole 2H from the upper part, and, as shown in FIG. 2, a bolt 6 is screwed into a male screw hole 5*m* of the hosel column 5 through a bolt inserting hole 7, so that hosel column 5 is fixed to the hosel column inserting hole 2H. The bolt inserting hole 7 penetrates from an innermost portion of the hosel column inserting hole 2H to a sole side of the head main body 2.

The hosel column 5 has a cylindrical trunk portion 5*a* and a leg portion 5*b* protruded from a lower end surface of the trunk portion 5*a*. On the trunk portion 5*a*, a shaft inserting hole 5H is recessed from the upper end surface. An inner peripheral surface of the shaft inserting hole 5H has a cylindrical shape as a whole.

An outer diameter of the trunk portion 5*a* of the hosel column 5 is the same as that of the upper end surface of the hosel portion 2*b*. For that reason, the head has a curved surface from the outer surface of the hosel portion 2*b* toward the outer surface of the trunk portion 5*a*, and the form of the head is elegant.

It is preferable that an outer diameter of the trunk portion 5*a* be about 12 to 20 mm, in particular, about 13 to 15 mm, and a length thereof be about 20 to 50 mm, in particular, about 30 to 40 mm. It is preferable that an inner diameter of the shaft inserting hole 5H be about 8 to 10 mm, in particular, about 8.5 to 9.5 mm. It is preferable that a depth of the shaft inserting hole 5H be about 20 to 40 mm, in particular, about 25 to 35 mm.

Figure 3:
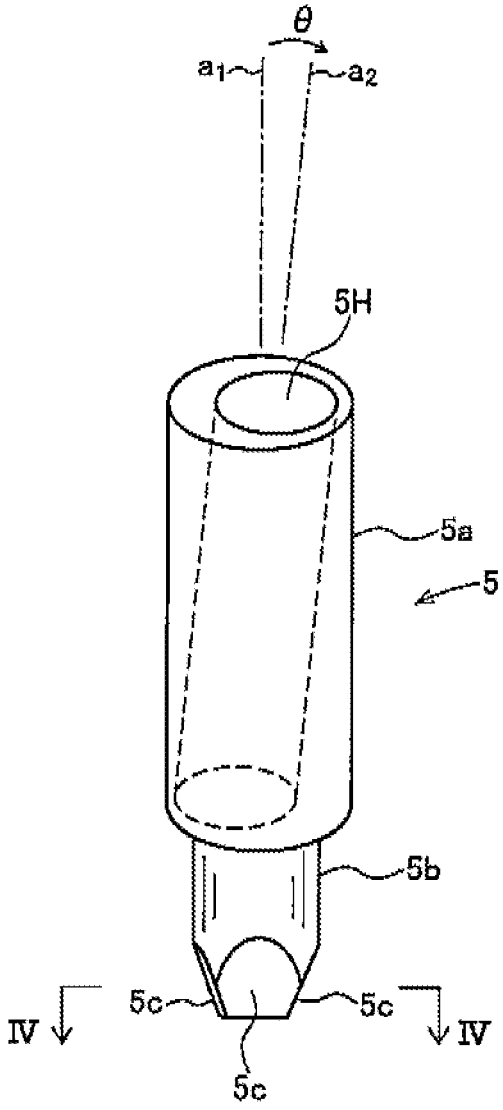
FIG. 3 is a perspective view of a hosel column.
Figure 4:
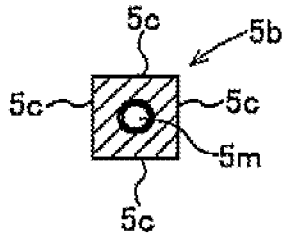
FIG. 4 is a sectional view of line IV-IV in FIG. 3.

As shown in FIG. 3, an upper half portion of the leg portion 5*b* of the hosel column 5 has a cylindrical form with a diameter smaller than that of the trunk portion 5*a*. As shown FIG. 4, the outer surface of the lower end side has a square pyramid shape (accurately, a truncated square pyramid shape) as it goes to the lower end, and has four-sided slope surfaces 5*c* provided thereon. The slope surfaces 5*c* are symmetrically provided with the axis center line of the hosel column 5 pinched therebetween. An intersecting angle of the pair of opposed slope surfaces 5*c* and 5*c* is the same as the intersecting angle of the slope surfaces 2*k* and 2*k*. In the center of the lower end surface of the leg portion 5*b*, a male screw portion 5*m* is provided toward the upper part.

The slope surface 5*c* of the lower portion of the hosel column 5 and the slope surface 2*k* of the inner side of the hosel column inserting hole 2H have square pyramid shapes in the present embodiment, but they may have regular triangular pyramid shapes, regular hexagonal pyramid shapes, regular octagonal pyramid shapes or the like, and preferably, square pyramids to regular octagonal pyramids.

In addition, in the lower end surface of the trunk portion 5*a*, the surrounding portion of the leg portion 5*b* is a plane which is vertical to the axis center line of the outer peripheral surface of the leg portion 5*a*. Although it is not shown, a bevelling with an angle of about 20 to 45° may be formed on the inner peripheral edge of the upper end side of the shaft inserting hole 5H to easily insert the shaft 4.

In assembling the golf club, the front end of the shaft 4 is inserted into the shaft inserting hole 5H and is fixed by an adhesive, the shaft 4 and the hosel column 5 are integrated to form a connection body of the hosel column and the shaft. Preferably, the adhesive is applied to the outer peripheral surface of the front end portion of the shaft 4 and is inserted up to the innermost portion of the shaft inserting hole 5H. It is preferable that the adhesive is an epoxy-based adhesive or the like. The hosel column leg portion 5*b* of the connection body of the hosel column and the shaft is inserted into the hosel column inserting hole 2H. Furthermore, in the present embodiment, although a thin ring-shaped packing 8 formed of rubber, elastomer or the like is interposed between the upper end surface of the hosel portion 2*b* and the lower end surface of the trunk portion 2*a*, the packing 8 may be omitted. In addition, on the slope surface 5*c* of the hosel column leg portion 5*b*, an elastic body with a slice shape such as thin (for example, a thickness of about 0.5 to 5 mm) rubber and elastomer may be provided by painting, gluing or the like. The elastic body may be provided on the hosel column leg portion 5*b* in advance, and may be provided on the hosel column leg portion 5*b* after constructing the connection body of the hosel column and the shaft.

After the hosel column leg portion 5*b* of the connection body of the hosel column and the shaft is inserted into the hosel column inserting hole 2H so as to overlap the slope surface 5*c* and the slope surface 2*k*, the bolt 6 is screwed into the male screw hole 5*m* of the hosel column 5 through the holder inserting hole 7.

Figure 1:
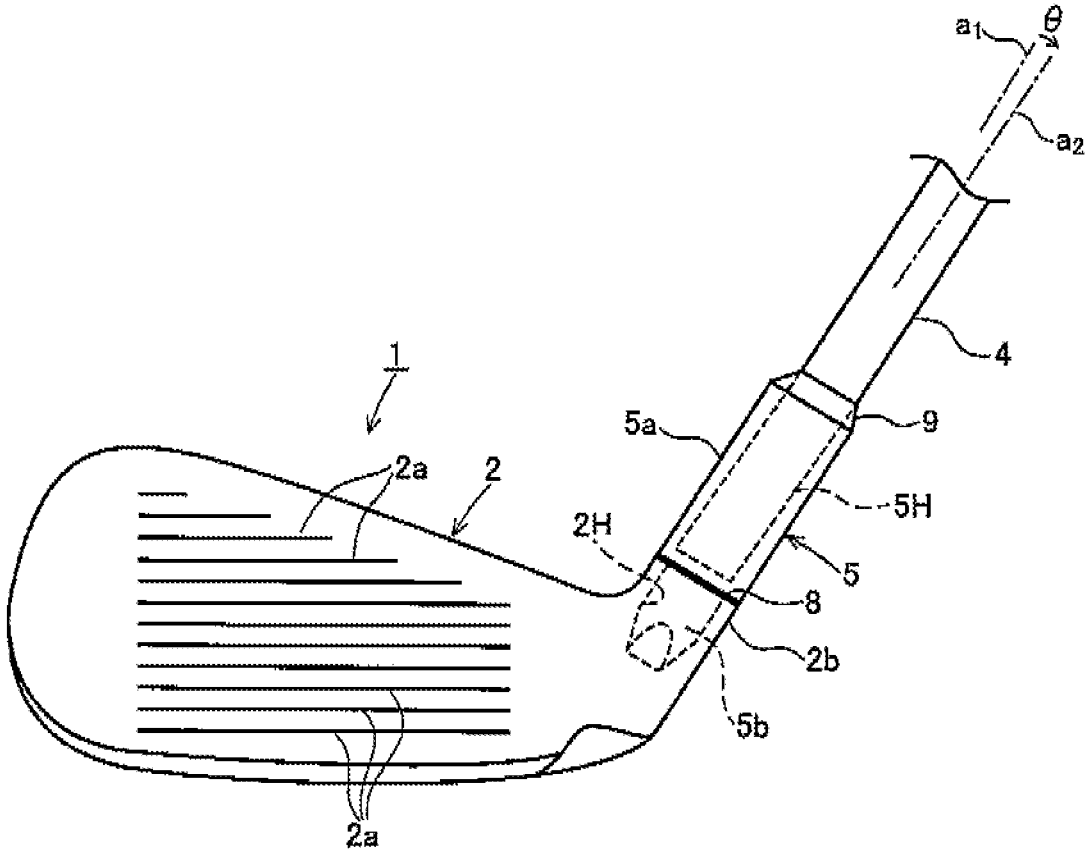
FIG. 1 is a front view of a head relating to a first embodiment.

As a result, as shown in FIGS. 1 and 2, the lower end surface of the leg portion 5*a* is pressed to the upper end surface of the hosel portion 2*a* via the packing 8, and the slope surface 5*c* of the hosel column 5 is pressed to the slope surface 2*k* of the hosel column inserting hole 2H, so that the hosel column 5 is fixed to the head main body 2. Since the hosel column 5 and the shaft 4 are fixedly bonded by the adhesive, the golf club with the shaft 4 and the head 1 integrally formed is completed. Furthermore, thereafter, a ferrule 9 is fixed by the adhesive.

In the present embodiment, the hosel column 5 tilts the axis center direction of the shaft inserting hole 5H with respect to the outer peripheral surface of the hosel column leg portion 5*a* and the axis center direction of the hosel column inserting hole 2H. That is, an axis center line $a_2$ of the shaft 4 and the shaft inserting hole 5H obliquely intersects an axis center line $a_1$ of the outer peripheral surface of the hosel column inserting hole 2H and the hosel column trunk portion 5*a*. It is desirable that an intersecting angle θ of the axis center lines $a_1$ and $a_2$ be about 0.1 to 5.0°, particularly, about 0.25 to 3.0°. A position where the axis center lines $a_1$ and $a_2$ intersect each other may be in an upper part of the shaft inserting hole 5H, and may be a lower part and a middle part thereof. When they intersect at the upper part, the upper end of the shaft inserting hole 5H is situated at the center of the upper end surface of the hosel column 5, so that the ferrule 9 becomes substantially regular conical shape, and the appearance thereof is satisfactory. When they intersect at the middle part, the intersecting angle θ can increase even if the hosel column 5 is made thinner.

In addition, the axis center lines $a_1$ and $a_2$ may not intersect, but may be in a relationship of "misalign". That is, the axis center lines $a_1$ and $a_2$ may be in a relationship in which the axis center line $a_2$ escapes through the vicinity of the axis center line $a_1$ without intersecting therewith. As for the angles of the axis canter lines $a_1$ and $a_2$ in this case, the axis center line $a_2$ may be set in a state of being most sloped to the heel side, and a plane extending in a flight ball line direction including the axis center line $a_1$ is assumed, whereby the intersecting angle of this plane and the axis center line $a_2$ may be in the range of the angle θ.

Figure 5:
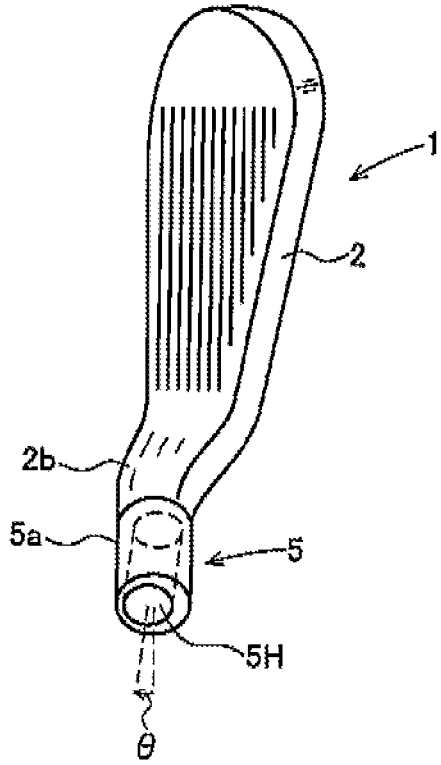
FIG. 5 is a plane view of the head of FIG. 1 with a phase of a hosel column being changed.
Figure 6:
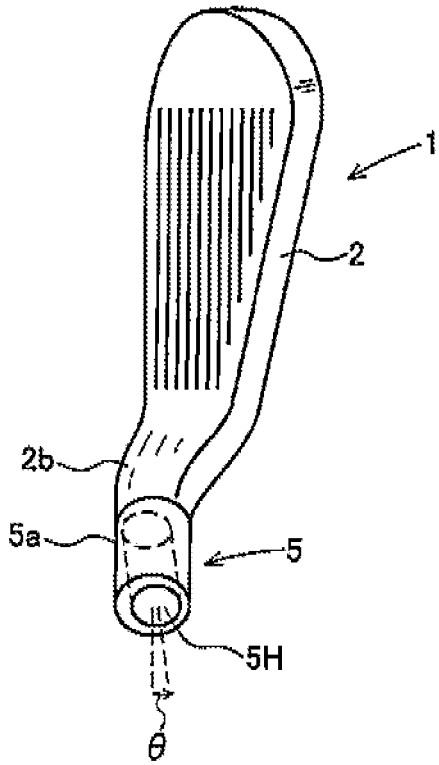
FIG. 6 is a plane view of the head of FIG. 1 with the phase of the hosel column being changed.
Figure 7:
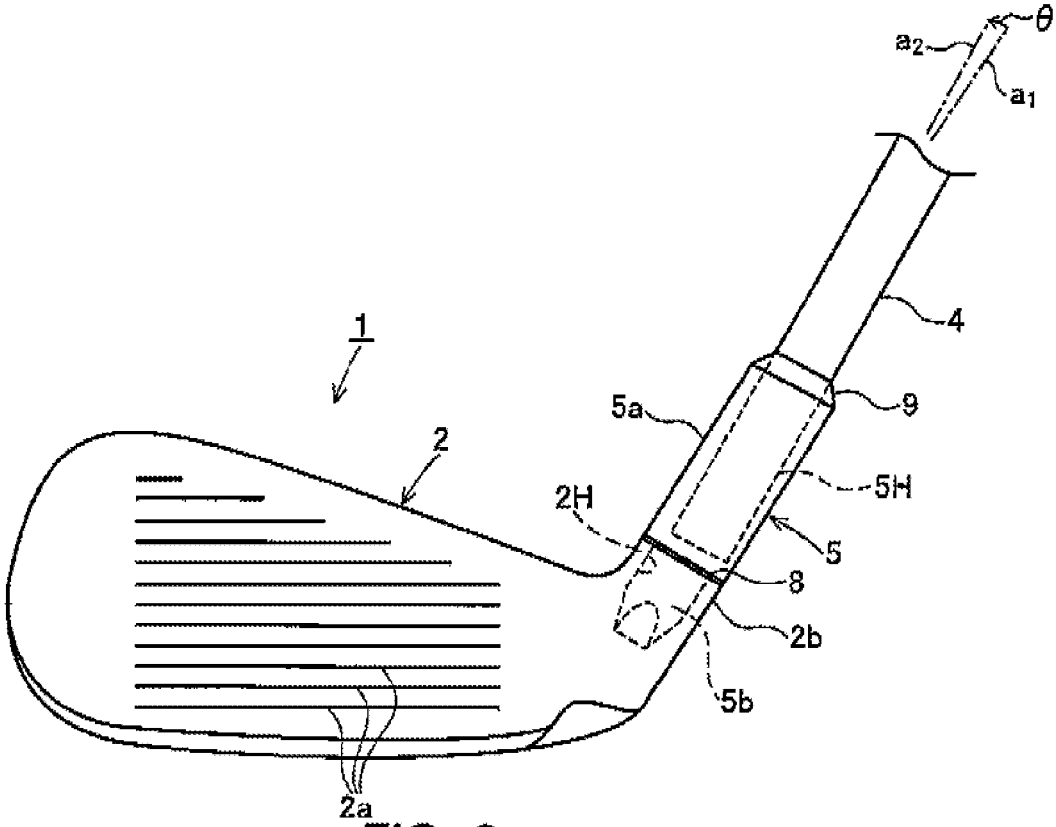
FIG. 7 is plane view of the head of FIG. 1 with the phase of the hosel column being changed.

In this manner, in the golf club using the hosel column 5 in which the shaft inserting hole 5H slopes with respect to the axis center lines $a_1$, by changing the phase of the hosel column 5, the slope direction of the shaft 4 can change. In FIGS. 1 and 2, the shaft 4 slopes to the most heel side. In FIG. 7 in which the hosel column 5 is rotated from FIG. 1 by 180°, the shaft 4 slopes to the outermost toe side. In FIG. 5 in which the hosel column 5 rotates from FIG. 1 in a clockwise direction by 90°, the shaft 4 slopes to the most face side (flight ball line front direction)). In FIG. 6 in which the hosel column 5 rotates from FIG. 1 in a counterclockwise direction by 90°, the shaft 4 slopes to the most backward.

In this manner, by rotating the hosel column 5 to change the slope direction of the shaft 4, the lie angle and the slice angle can be changed.

Regarding the lie angle, it is the minimum in FIG. 1 and a flat lie, and it is the maximum in FIG. 7 and is an up lie.

Regarding the slice angle, in a state of being sloped to the most face surface (FIG. 5), it becomes a hook face in which the face surface is closed the most, and on the contrary, in FIG. 6 in which the angle slopes backward the most (not shown), it becomes a slice face in which the face surface is opened the most.

In this manner, by changing the direction (the phase) of the hosel column 5, the inclined angle of the shaft 4 relative to the head 1 can be changed, which makes it possible to change the lie angle and the slice angle. If the slope surface 5*c* of the hosel column 5 and the slope surface 2*k* of the hosel column inserting hole 2H have regular octagonal pyramid shapes, it is possible to change the phase of the hosel column 5 by 45°.

In addition, when the packing or the elastic body with the slice shape formed of a rubber, an elastomer, a synthetic resin or the like is interposed between the hosel column 5 and the hosel portion 2*a*, a shock or a vibration at the time of impact can be absorbed. However, the packing or the elastic body may be omitted.

In the present embodiment, since the inner surface of the inner side of the hosel column inserting hole 2H and the outer surface of the lower end side of the hosel column 5 are formed to the slope surfaces with regular polygonal pyramid shape, respectively to engage the slope surfaces with each other, the rattling is reduced and the rotation of the shaft 4 around the axis center of the shaft in the circumferential direction is prevented. That is, a fixing rigidity of the hosel column in a torque direction is improved.

In the present embodiment, the diameter of the leg portion 5*b* of the hosel column 5 is made smaller than that of the trunk portion 5*a*, and only the leg portion 5*b* is inserted into the hosel column inserting hole 2H. Thus, an increase in weight in heel side of the head is suppressed without excessively increasing the diameter of the hosel portion 2*b*.

In addition, since the front end side of the leg portion 5*b* of the hosel column 5 is formed in the shape of a taper, it is easily inserted into the hosel column inserting hole 2H.

Figure 8:
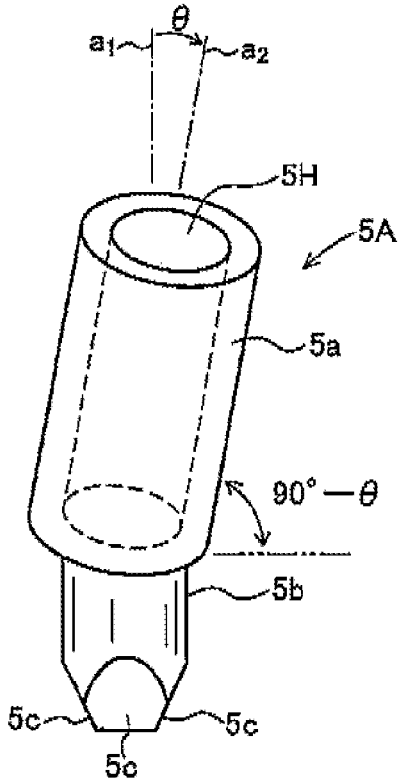
FIG. 8 is a perspective view of a hosel column of a head relating to a second embodiment.
Figure 9:
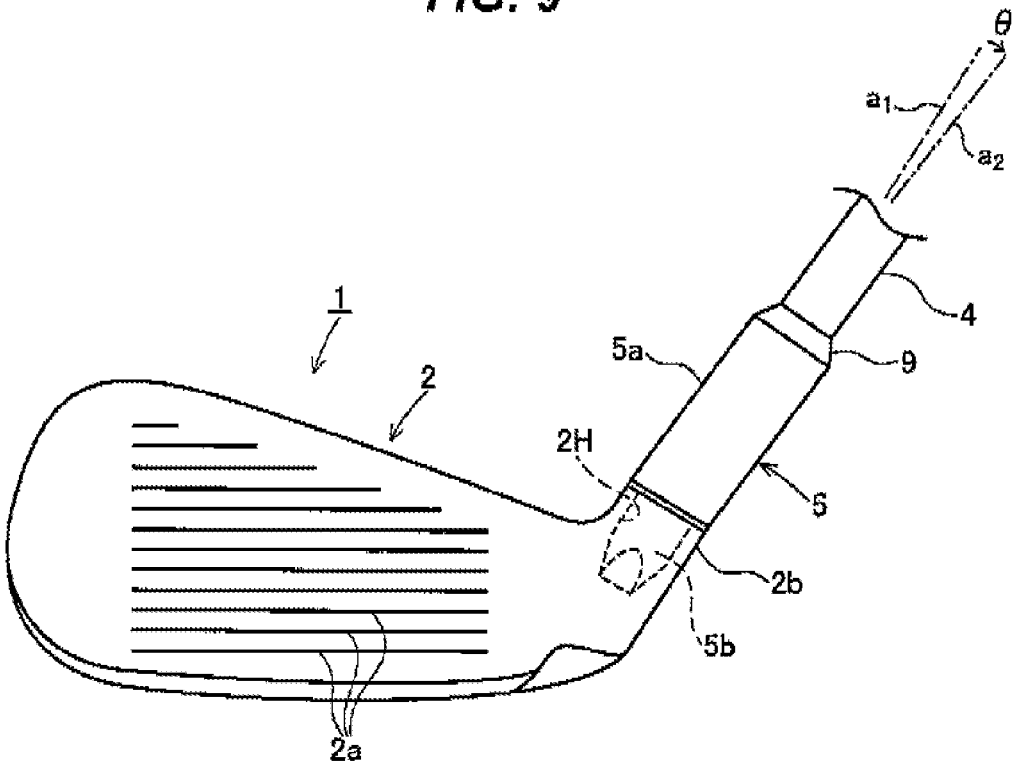
FIG. 9 is a front view of a head of a golf club which uses the hosel column of FIG. 8.
Figure 10:
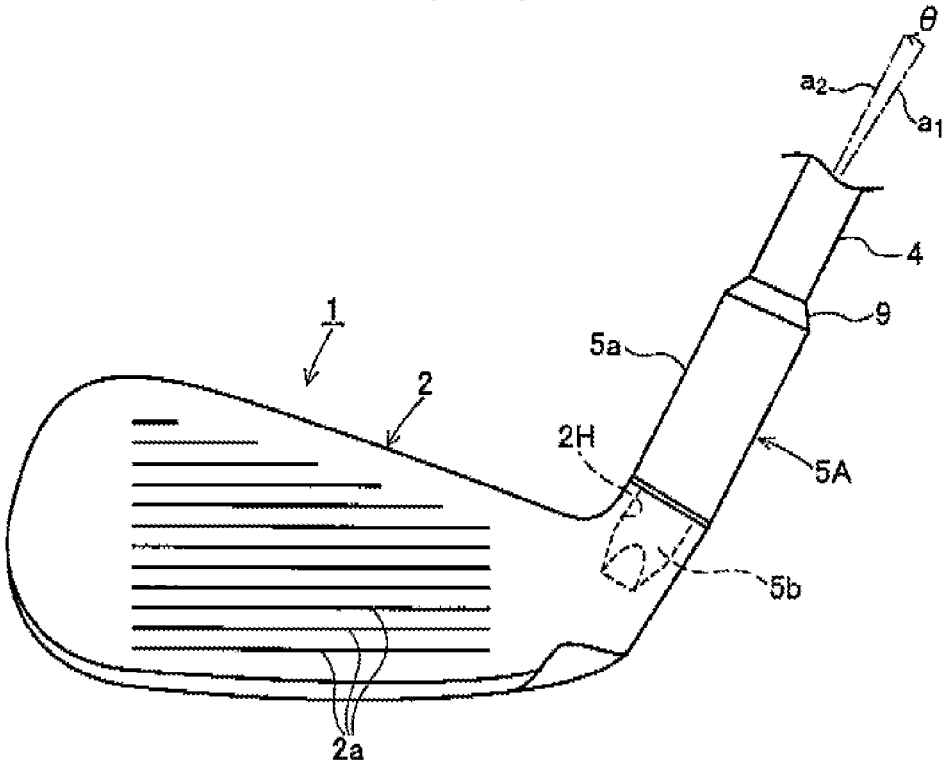
FIG. 10 is a front view of the head of FIG. 9 with the phase of the hosel column being changed.

FIG. 8 is a perspective view of a hosel column 5A which is used in a second embodiment. FIGS. 9 and 10 are front views of a head using the hosel column 5A.

The hosel column 5A also includes the trunk portion 5*a* and the leg portion 5*b* in the same manner as the hosel column 5, and the shaft inserting hole 5H is provided on the trunk portion 5*a*.

In the present embodiment, the outer peripheral surface of the trunk portion 5*a* is in common with the axis center line $a_2$ of the shaft inserting hole 5H. In addition, the axis center line $a_2$ slopes with respect the axis center line $a_1$ of the hosel column inserting hole 2H by angle θ.

The most sloped side of the outer peripheral surface of the trunk portion 5*a* intersects the lower end surface of the trunk portion 5*a* by (90°-θ).

Another configuration of the head 1 in which the hosel column 5A is installed in the head main body 2 is the same as the head of the above-mentioned first embodiment, and the hosel column 5A is fixed by the bolt 6 (not shown in FIGS. 9 and 10).

Even in the present embodiment, in the same manner as the first embodiment, the slice angle can be controlled.

Figure 11:
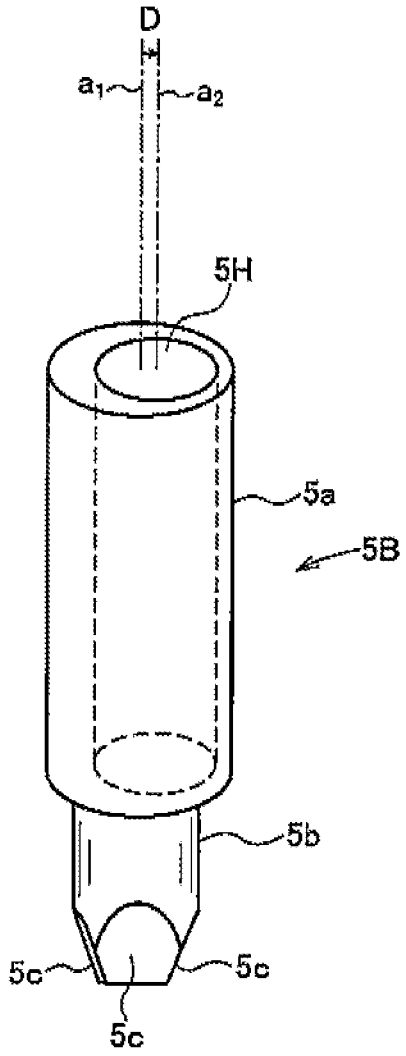
FIG. 11 is a perspective view of a hosel column of a head relating to a third embodiment.
Figure 12:
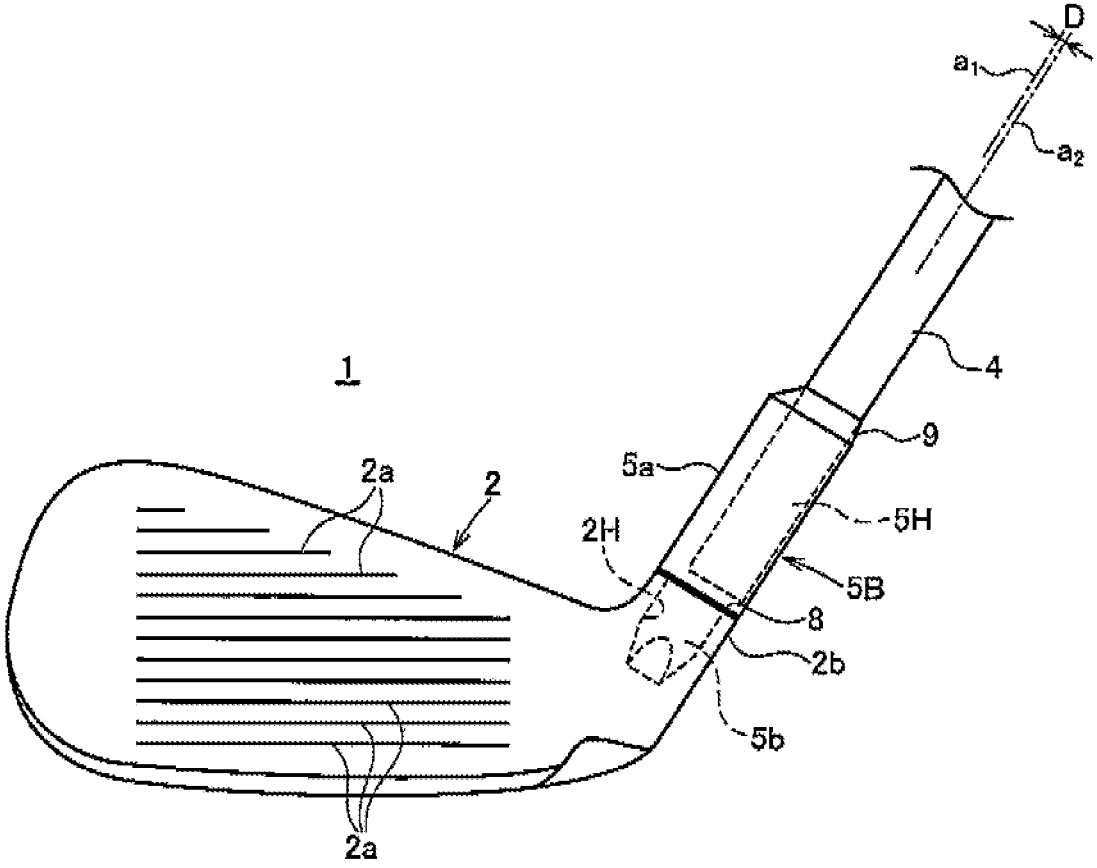
FIG. 12 is a front view of a head of a golf club which uses the hosel column of FIG. 11.
Figure 13:
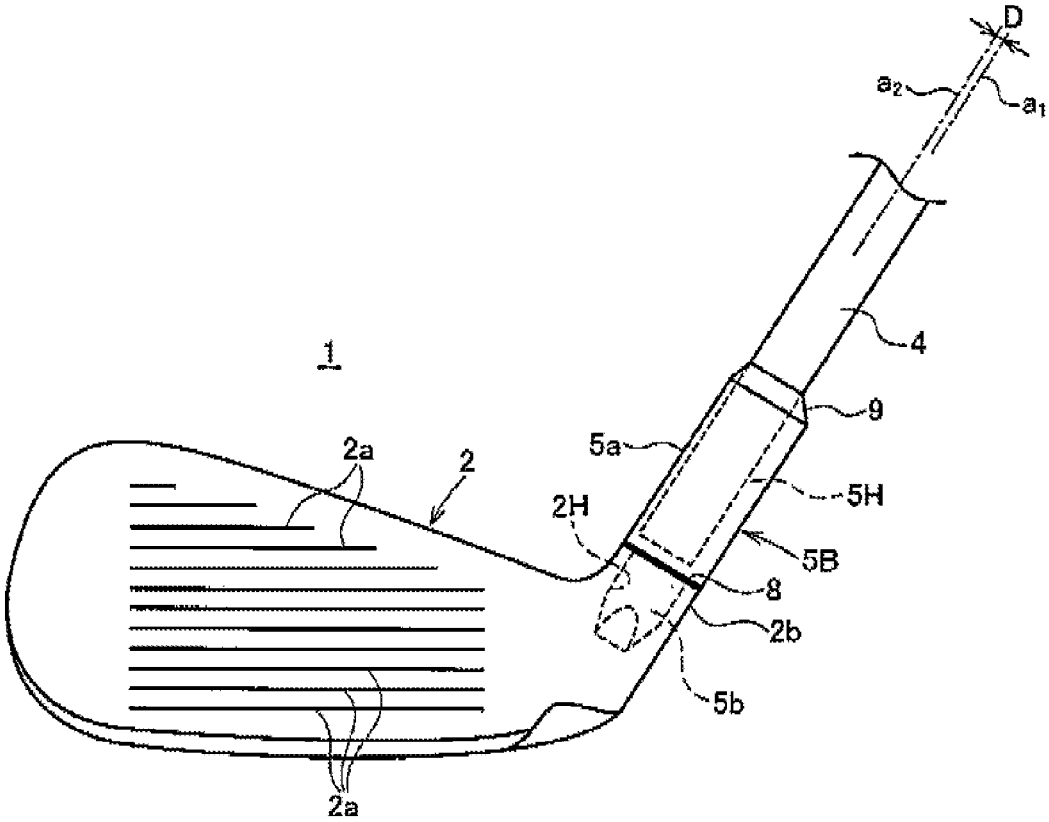
FIG. 13 is a front view of the head of FIG. 12 with the phase of the hosel column being changed.
Figure 14:
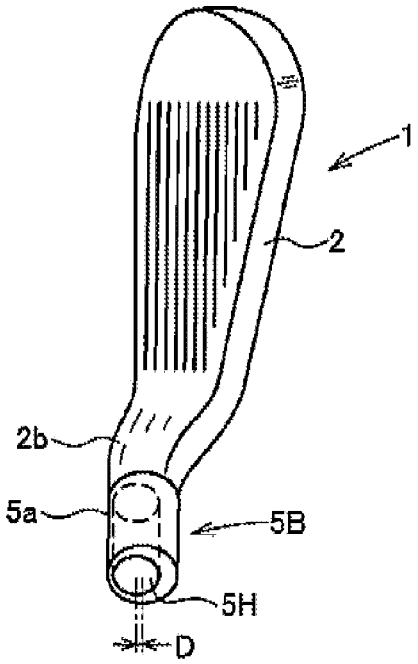
FIG. 14 is a plane view of the head of FIG. 12 with the phase of the hosel column being changed.
Figure 15:
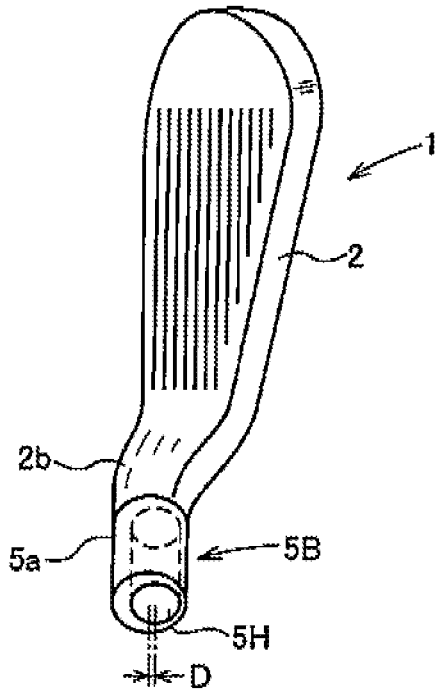
FIG. 15 is a plane view of the head of FIG. 12 with the phase of the hosel column being changed.

FIG. 11 is a perspective view of a hosel column 5B used in a third embodiment. FIG. 12 is a front view of a head which uses the hosel column 5B. FIG. 13 is a front view of the head with a phase of the hosel column 5B being changed from FIG. 12 by 180°. FIGS. 14 and 15 are plane views of the head with the phase of the hosel column 15B being respectively changed from FIG. 12 in a clockwise direction and in a counterclockwise direction by 90°.

The hosel column 5B also includes the trunk portion 5*a* and the leg portion 5*b* in the same manner as the hosel columns 5 and 5A, and the shaft inserting hole 5H is provided on the trunk portion 5*a*.

In the present embodiment, as shown in FIG. 11, the axis center line $a_2$ of the shaft 4 and the shaft inserting hole 5H is substantially parallel to the axis center line $a_1$ of the leg portion 5*b* and the hosel column inserting hole 2H, and is disposed so as to be separated from the axis center line $a_1$ by a predetermined distance D. That is, the hosel column 5B deviates (eccentric) the shaft 4 from the axis center of the hosel column inserting hole 2H and is connected to the head 1. It is desirable that the separation distance of the axis center line $a_1$ of the hosel column inserting hole 2H and the axis center line $a_2$ of the shaft 4 be, for example, about 0.5 to 4.0 mm.

Another configuration of the head 1 in which the hosel column 5B is installed in the head main body 2 is the same as the head of the above-mentioned first embodiment, and the hosel column 5B is fixed by the bolt 6 (not shown in FIGS. 11 to 15).

In this manner, in the golf club using the hosel column 5B in which the shaft inserting hole 5H is disposed in parallel to the axis center line $a_1$ so as to be separated by a predetermined distance, by changing the phase of the hosel column 5B, it is possible to change the position of the shaft 4 in a toe and heel direction of the head 1 and in a flight ball line front and rear direction.

That is, in FIG. 12, the shaft 4 is disposed at the most heel side. In FIG. 13 in which the hosel column 5B is rotated from FIG. 12 by 180°, the shaft 4 is disposed at the most toe side. In FIG. 14 in which the hosel column 5B rotates from FIG. 12 in a clockwise direction by 90°, the shaft 4 is disposed at the most front side of the flight ball line. In FIG. 15 in which the hosel column 5B rotates from FIG. 12 in a counterclockwise direction by 90°, the shaft 4 is disposed at the most rear side of the flight ball line.

In a case where the shaft 4 is disposed at the heel side as shown in FIG. 12, a distance from the shaft 4 to the center of the head 1 increases and the head 1 does not easily return during swing. Furthermore, in a case where the shaft 4 is disposed at the toe side as shown in FIG. 13, the distance from the shaft 4 to the center of the head 1 decreases and the head 1 easily rotates during swing.

In a case where the shaft 4 is disposed in the flight ball line front side as shown in FIG. 14, the head 1 retreats and is deeply centered, so the hit ball hardly slices. Furthermore, in a case where the shaft 4 is disposed at the flight ball line rear side as shown in FIG. 15, head 1 is situated on the front part further than FIG. 14 and is shallowly centered, so the hit ball is hard to hook.

Furthermore, in the present embodiment, since the leg portion 5*b* of the lower end side of the hosel column 5B and the inner portion of the hosel column inserting hole 2H have square pyramid shapes, it is possible to change the phase of the hosel column 5B by 90°. However, if they have regular octagonal pyramid shapes, it is possible to change the phase of the hosel column 5B by 45°.

Other working effects of the hosel column 5B are the same of those of the hosel column 5.

Figure 16:
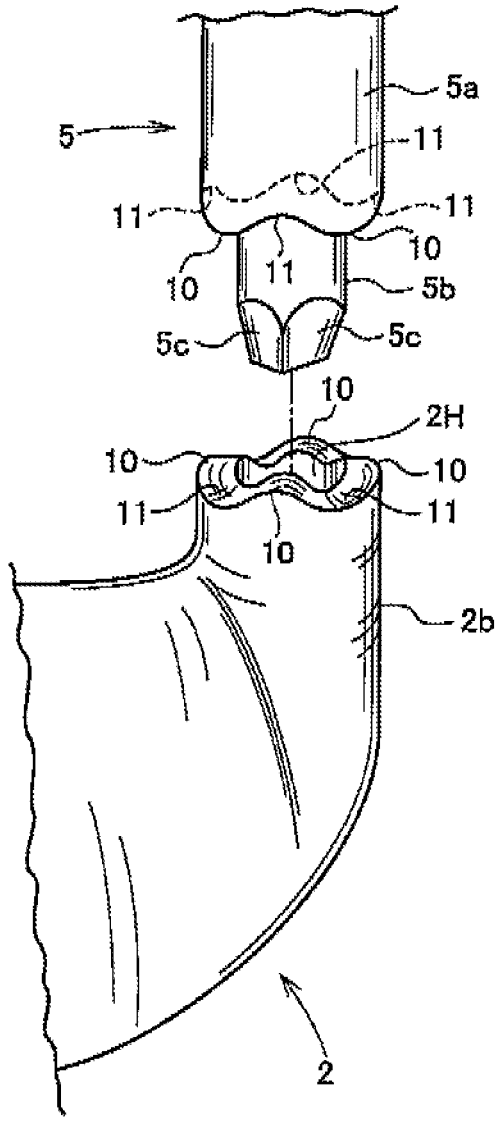
FIG. 16 is an exploded perspective view of a head main body of a head and a hosel column relating to a fourth embodiment.

FIG. 16 is an exploded perspective view of a head main body 2 of a head and a hosel column 5 relating to a fourth embodiment.

In the present embodiment, a plurality of convex portions 10 and concave portions 11 which can be engaged with each other is respectively provided on an upper end surface of the hosel portion 2*b* around the hosel column inserting hole 2H and a lower end surface of the hosel column trunk portion 5*a* around the leg portion 5*b*. In the upper end surface of the hosel portion 2*b* and lower end surface of the hosel column trunk portion 5*a*, each convex portion 10 is disposed in a circumferential direction of the hosel column inserting hole 2H with a predetermined gap, and between the adjacent convex portions 10 and 10 among the upper end surface of the hosel portion 2*b* and the lower end portion of the hosel column trunk portion 5*a*, the concave portions 11 are respectively formed. When the leg portion 5*b* is inserted to the hosel column inserting hole 2H so that each of the slope surfaces 5*c* and 2*k* overlap with each other, each convex portion 10 of the upper end surface of the hosel portion 2*b* is engaged with each concave portion 11 of the lower end surface of the hosel column trunk portion 5*a*, and each convex portion 10 of the lower end surface of the hosel column trunk portion 5*a* is engaged with each concave portion 11 of the upper end surface of the hosel portion 2*b*.

In the present embodiment, on the upper end surface of the hosel portion 2*b* and the lower end surface of the hosel column trunk portion 5*a*, the convex portions 10 and the concave portions 11 are provided in the same number as the angle numbers (i.e., the numbers of the slope surfaces 5*c* and 2*k*) of the polygonal section shape portions of the lower end side of the leg portion 5*b* and the inner side of the hosel column inserting hole 2H. That is, in the present embodiment, since the lower end side of the leg portion 5*b* and the inner side of the hosel column inserting hole 2H have the square pyramid shapes, respectively, on the upper end surface of the hosel portion 2*b* and the lower end surface of the hosel column trunk portion 5*a*, four convex portions 10 and concave portions 11 are respectively provided. However, when the lower end side of the leg portion 5*b* and the inner side of the hosel column inserting hole 2H have octagonal pyramid shapes, respectively, it is desirable that eight convex portions 10 and concave portions 11 be respectively provided on the upper end surface of the hosel portion 2*b* and the lower end surface of the hosel column trunk portion 5*a*.

In the present embodiment, as shown in FIG. 16, the upper end surface of the hosel portion 2*b* and the lower end surface of the hosel column trunk portion 5*a* are uneven surfaces which are curved in the shape of a wave so that the front end portion of each convex portion 10 and the deepest portion of each concave portion 11 are smoothly fastened in the circumferential direction of the hosel column inserting hole 2H. When each convex portion 10 and each concave portion 11 of the hosel portion 2*b* side are engaged with each concave portion 11 and each convex portion 10 of the hosel column trunk portion 5*a*, respectively, the upper end surface of each hosel portion 2*b* and the lower end surface of the hosel column trunk portion 5*a* come into close contact with each other over the overall periphery. Furthermore, the shapes (shapes of each convex portion 10 and concave portion 11) of the upper end surface of the hosel portion 2*b* and the lower end surface of the hosel column trunk portion 5*a* are not limited thereto. For example, the upper end surface of the hosel portion 2*b* and the lower end surface of the hosel column trunk portion 5*a* may be uneven surfaces which include convex portions 10 and concave portions 11 with angled shapes such as saw teeth and clamps. Only the concave portions 10 may be provided on one side of the upper end surface of the hosel portion 2*a* and the lower end surface of the hosel column trunk portion 5*a*, and only the concave portions 11 may be provided on the other side thereof. A packing (not shown) may be interposed between the upper end surface of the hosel portion 2*b* and the lower end surface of the hosel column trunk portion 5*a*.

Other configurations of the present embodiment are the same as the first embodiment, and the leg portion 5*b* is inserted to the hosel column inserting hole 2H and the hosel column 5 is fixed by a bolt 6 (not shown in FIG. 16).

In the present embodiment, when the leg portion 5*b* of the hosel column 5 is inserted into the hosel column inserting hole 2H, in addition to the overlapping of each slope surface 5*c* of the lower end side of the leg portion 5*b* and each slope surface 2*k* of the inner side of the hosel column inserting hole 2H, each convex portion 10 and each concave portion 11 of the upper end surface of the hosel portion 2*b* are engaged with each concave portion 11 and each convex portion 10 of the lower end surface of the hosel column trunk portion 5*a*, respectively. Thus, a rotation preventing effect of the shaft 4 in a direction around the axis center of the shaft, that is, fixing rigidity of the shaft 4 in a torque direction, is improved.

Furthermore, in the present embodiment, the convex portions 10 and the concave portions 11 are respectively provided in the same number as the slope surfaces 5*c* and 2*k* on the upper end surface of the hosel portion 2*b* and the lower end surface of the hosel column trunk portion 5*a*. Thus, if the hosel column leg portion 5*b* is inserted into the hosel column inserting hole 2H while matching the phase of the hosel column 5 so that each convex portion 10 of one side of the upper end surface of the hosel portion 2*b* and the lower end surface of the hosel column trunk portion 5*a* confronts each concave portion 11 of the other side thereof, each of the slope surfaces 5*c* and 2*k* automatically overlap each other. As a result, when the lower end side of the hosel portion 5*b* is inserted into the hosel column inserting hole 2H, even if it is difficult to recognize each of the slope surfaces 5*c* and 2*k*, the phase matching of the hosel column 5 can easily be performed while seeing the convex portions 10 and the concave portions 11.

FIG. 16 shows an embodiment in which the convex portions 10 and the concave portions 11 engaged with each other are respectively provided on the lower end surface of the hosel column 5 and the upper end surface of the hosel portion 2*b* in the embodiments of FIGS. 1 to 7 using the hosel column 5. However, even the embodiments of FIGS. 8 to 10 using the above-mentioned hosel column 5A and the embodiments of FIGS. 11 to 15 using the hosel column 5B can have the same configurations as those of FIG. 16.

In the present invention, the exchanging of the shaft of the golf club can also easily be performed. When performing the shaft exchange, a hosel column 5 with the same shape as the hosel column 5 (or 5A or 5B, hereinafter, identical) is fixed to a new shaft to be exchanged by the adhesive in advance.

The bolt 6 of the existing golf club is removed to detach the old shaft 4 together with the hosel column 5 from the main body 2. Next, a new shaft with a hosel column (the connection body of the hosel column and the shaft) is inserted to the hosel column inserting hole 2H and is fixed by screwing the bolt 6 into the male screw hole 5*m*.

In this manner, the attachment or the exchanging of the shaft can be performed extremely simply and rapidly. Furthermore, in the related art, it is configured so that the hosel portion of the existing golf club is heated to destroy the structure of the adhesive hardening product when exchanging the shaft, the shaft is pulled out, and then a new shaft is fixed by the adhesive. Thus, the time is taken in the range from some hours to one day. However, in the above-mentioned embodiments, by attaching the hosel column 5 to a new shaft with the adhesive in advance, the shaft exchanging can be performed in a few minutes. Thus, a method of use can be realized in which the shaft of various specs with the hosel column attached thereto are prepared, and the different shafts are sequentially attached to the same head main body to perform a trial hit.

Furthermore, the hosel column in which the slope angle θ of the shaft inserting hole 5H has various differences may be produced. For example, by preparing a plurality of types of hosel column groups in which the angle θ gradually changes such as 0.5°, 1°, 1.5°, 2°, 2.5° and 3° as an exchanging hosel column, it is possible to gradually change the lie angle or the slice angle to perform the trial hit.

It is desirable that the hosel column be made of metal, particularly, be made of aluminum or titanium or alloy thereof. It is desirable that the hosel column be made of the same material as the head main body or a material with a specific gravity lower than the material of the head main body. For example, stainless steel, titanium alloy, aluminum, aluminum alloy, magnesium alloy, FRP, synthetic resin or the like may be used.

In the present invention, the head main body can be stainless steel or titanium alloy, the hosel column can be aluminum alloy and is desirably made hard (a hard alumite treatment of Hv 250 to 600, preferably, Hv 400 or more) by an anodic treatment. The bolt for fixing the hosel column to the head main body is desirably steel (for example, stainless steel. However, the material of the bolt is not limited thereto) subjected to chrome plating. This is to prevent abrasion resistance from being highly damaged due to repeatedly detached and attached.

A plurality of slope surfaces is provided in the hosel column and the hosel column inserting hole so as to form the regular polygonal pyramid shape in the above-mentioned embodiments. However, the front end side of the hosel column and the inner portion of the hosel column inserting hole may be formed in the shape of a concaved polygonal section such as a star shape or in the shape of a gear teeth section.

Although the head 1 is an iron type golf club head in the above-mentioned embodiments, the present invention can also be applied to a wood type golf club head.

Figure 17A:
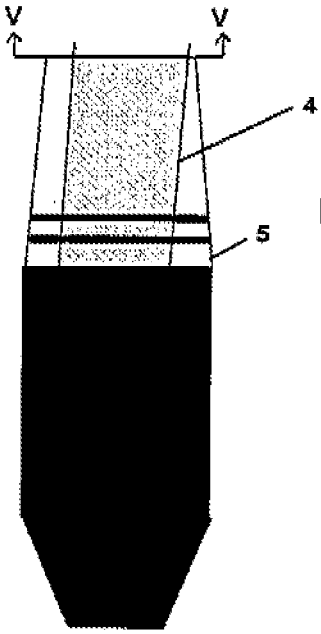
FIGS. 17A to 17D are views exemplary showing configurations that a shaft is inserted into the a shaft holder at an angle.
Figure 17B:
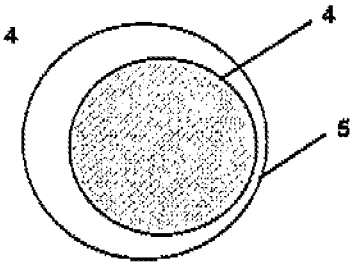
Figure 17C:
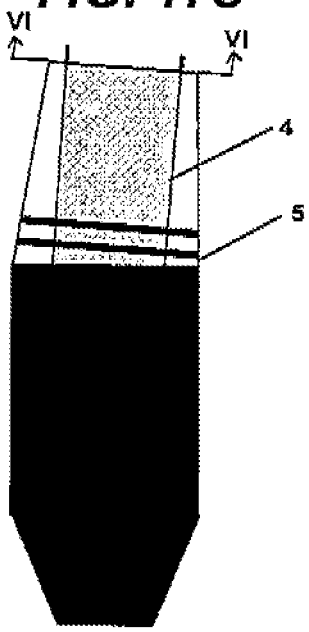
Figure 17D:
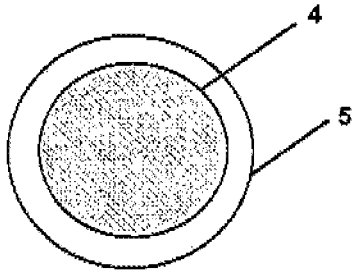

In addition, in a case that the shaft 4 is inserted into the hosel column 5 at an angle as shown in FIG. 17A, the shaft 4 may be eccentrically-fixed to the hosel column 5 as shown in FIG. 17B. Besides, FIG. 17B is a sectional view taken from line V-V in FIG. 17A. On the other hand, an upper portion of the hosel column 5 may be provided at an angle according to an insertion angle of the shaft 4 as shown in FIG. 17C. In this configuration, the shaft 4 can be concentrically-fixed to the hosel column 5 as shown in FIG. 17D. Besides, FIG. 17D is a sectional view taken from line VI-VI in FIG. 17C.

What is claimed is:

1. A golf club head comprising:

a head main body formed with a hosel column inserting hole which is recessed from an upper end surface of the hosel portion;

a hosel column which is formed with a shaft inserting hole and is attachably and detachably installed on the hosel column inserting hole;

a bolt inserting hole penetrating from a sole side of the head main body to the hosel column inserting hole; and a bolt which is inserted into the bolt inserting hole and is screwed into the hosel column to fix the hosel column to the head main body, wherein:

the hosel column includes a trunk portion provided with a shaft inserting hole, and a leg portion which protrudes from a lower end surface of the trunk portion and is inserted into the hosel column inserting hole;

at least a lower end side of the leg portion and an inner portion of the hosel column inserting hole are polygonal sectional shape portions and are engaged with each other; and an elastic body interposed between the regular polygonal pyramid portion of the hosel column and the regular polygonal pyramid portion of the hosel column inserting hole, wherein:

a diameter of the leg portion is smaller than that of the trunk portion;

an inner peripheral surface of an upper portion of the hosel column inserting hole and an outer peripheral surface of an upper portion of the hosel column are cylindrical portions, respectively; and lower sides of the cylindrical portions are regular polygonal pyramid portions that shrink toward a lower part.

2. The golf club head according to claim 1, wherein an axis center of the shaft inserting hole and an axis center of the hosel column inserting hole have non-coaxial shapes.

3. The golf club head according to claim 2, wherein the axis center of the shaft inserting hole is inclined with respect to the axis center of the hosel column inserting hole.

4. The golf club head according to claim 2, wherein the axis center of the shaft inserting hole is parallel to the axis center of the hosel column inserting hole, and the axis center of the shaft inserting hole is separated from the axis center of the hosel column inserting hole by a predetermined distance.

5. The golf club head according to claim 1, wherein the lower end surface of the trunk portion is in contact with the upper end surface of the hosel portion directly or via a packing.

6. The golf club head according to claim 5, further comprising:

convex portions protruding from one side of the upper end surface of the hosel portion and the lower end surface of the trunk portion toward the other side thereof; and concave portions engaged with the convex portions are formed on the other side, wherein the convex portions and the concave portions is respectively provided with gaps in a circumferential direction of the hosel column inserting hole.

7. The golf club head according to claim 6, wherein the convex portions and the concave portions are respectively provided in the same number as the number of angles of polygonal section shape portions of a lower end side of the leg portion and an inner portion of the hosel column inserting hole.

8. The golf club head according to claim 1, wherein an outer peripheral surface of the hosel portion is continuously formed with an outer peripheral surface of the trunk portion.

9. The golf club head according to claim 1, wherein the golf club head is an iron type golf club head.

10. The golf club head according to claim 1, wherein:

an upper half portion of the leg portion has a cylindrical form with a diameter smaller than a diameter of the trunk portion;

an outer surface of the lower end side of the leg portion has a truncated square pyramid shape and has slope surfaces; and a male screw portion is provided in a center of the lower end surface of the leg portion.

11. The golf club head according to claim 1, wherein the trunk portion is exposed on the outside when the leg portion is inserted in to the hosel column inserting hole.

12. The golf club head according to claim 1, wherein the hosel column is made of metal having a specific gravity that is lower than a specific gravity of the head main body.

13. The golf club head according to claim 1, wherein:

the head main body is made of stainless steel or titanium allow; and the hosel column is made of aluminum alloy and is made hard by an anodic treatment.

* * * * *